US008888230B2

(12) United States Patent
Seshimo

(10) Patent No.: US 8,888,230 B2
(45) **Date of Patent: *Nov. 18, 2014**

(54) FLUID EJECTING APPARATUS

(75) Inventor: Tatsuya Seshimo, Asahi-mura (JP)

(73) Assignee: Seiko Epson Corporation, Tokyo (JP)

( * ) Notice: Subject to any disclaimer, the term of this patent is extended or adjusted under 35 U.S.C. 154(b) by 315 days.

This patent is subject to a terminal disclaimer.

(21) Appl. No.: 12/617,522

(22) Filed: Nov. 12, 2009

(65) Prior Publication Data

US 2010/0118084 A1 May 13, 2010

(30) Foreign Application Priority Data

Nov. 13, 2008 (JP) ..... 2008-291059
Sep. 24, 2009 (JP) ..... 2009-219384
Sep. 24, 2009 (JP) ..... 2009-219385
Sep. 24, 2009 (JP) ..... 2009-219386

(51) Int. Cl.
*B41J 2/165* (2006.01)

(52) U.S. Cl.
CPC ..... *B41J 2/16526* (2013.01); *B41J 2/16511* (2013.01)
USPC ..... 347/22

(58) Field of Classification Search
None
See application file for complete search history.

(56) References Cited

U.S. PATENT DOCUMENTS 5,472,065 A * 12/1995 Vergin ..... 185/40 R
5,847,674 A * 12/1998 Paroff et al. ..... 347/33
6,189,989 B1 2/2001 Hirabayashi et al.
6,679,578 B2 1/2004 Arakawa
7,401,885 B2 * 7/2008 Yamazaki et al. ..... 347/20
7,562,961 B2 7/2009 Inoue
2005/0062797 A1 3/2005 Kachi
2007/0052786 A1 3/2007 Nakazawa
2010/0118084 A1 5/2010 Seshimo
2011/0285784 A1 11/2011 Miyazawa et al.

FOREIGN PATENT DOCUMENTS

JP 10-337885 12/1998
JP 2002-355991 12/2002
JP 2002355991 A * 12/2002
JP 2003-063033 3/2003
JP 2003-182102 7/2003
JP 2005-22305 1/2005
JP 2005-119284 5/2005
JP 2006-056047 3/2006
JP 2007-62271 3/2007
JP 2008-155386 7/2008
JP 2008-302562 12/2008

OTHER PUBLICATIONS

U.S. Appl. No. 13/108,396, Jun. 12, 2012, Office Action.

* cited by examiner

*Primary Examiner* — Matthew Luu
*Assistant Examiner* — Erica Lin
(74) *Attorney, Agent, or Firm* — Workman Nydegger

(57) ABSTRACT

A fluid ejecting apparatus includes: a fluid ejecting head which includes nozzle rows each having a plurality of nozzles and ejects a fluid onto a medium, the fluid ejecting apparatus being capable of performing a flushing operation in which the fluid is ejected to an absorbing member used to absorb the fluid ejected from the nozzles, wherein the absorbing member is a linear member which extends along the nozzle row and is capable of relatively moving to a position retracted from a flying path of the fluid ejected from the nozzles.

18 Claims, 11 Drawing Sheets

FLUID EJECTING APPARATUS

The entire disclosure of Japanese Patent Application Nos. 2008-291059, filed Nov. 13, 2008, 2009-219384, filed Sep. 24, 2009, 2009-219385, filed Sep. 24, 2009, 2009-219386, filed Sep. 24, 2009, are expressly incorporated by reference herein.

BACKGROUND

1. Technical Field

The present invention relates to a fluid ejecting apparatus such as an ink jet printer.

2. Related Art

An ink jet printer (hereinafter, referred to as "a printer") is widely known as a fluid ejecting apparatus which ejects ink droplets onto a printing sheet (medium). In this kind of printer, since ink evaporates from a nozzle of a printing head, ink in the nozzle is thickened or solidified, dust is attached to the nozzle, and bubble is mixed with the ink in the nozzle, which causes an erroneous printing operation. Therefore, generally, in a printer, in addition to an ejection operation of ejecting ink to a printing sheet, a flushing operation of compulsorily ejecting ink in the nozzle to the outside is performed.

In a scanning-type printer, the flushing operation is performed by moving a printing head to an area other than a printing area. However, in a printer including a line head in which a printing head is fixed, the printing head cannot move during a flushing operation. Therefore, for example, JP-A-2005-119284 proposes a method of ejecting ink toward absorbing members provided in a surface of a sheet transporting belt.

However, in the method disclosed in JP-A-2005-119284, since the plural absorbing members are arranged at the same interval on the sheet transporting belt in accordance with the size of the printing sheet, problems arise in that ink needs to be ejected every gap between the printing sheets during the flushing operation, and in that the size or transporting speed of the printing sheet is limited. In addition, when the flushing operation is performed on a planar absorbing member, ink is scattered in the form of a mist due to a wind pressure caused by an operation of ejecting ink droplets, which may contaminate the printing sheet or the sheet transporting belt.

SUMMARY

An advantage of some aspects of the invention is that it provides a fluid ejecting apparatus and a maintenance device capable of rapidly performing a cleaning (flushing) operation with a simple configuration.

In order to achieve the above-described object, according to an aspect of the invention, there is provided a fluid ejecting apparatus including: a fluid ejecting head which includes nozzle rows each having a plurality of nozzles and ejects a fluid onto a medium, the fluid ejecting apparatus being capable of performing a flushing operation in which the fluid is ejected to an absorbing member used to absorb the fluid ejected from the nozzles, wherein the absorbing member is a linear member which extends along the nozzle row and is capable of relatively moving to a position retracted from a flying path of the fluid ejected from the nozzles.

With the above-described configuration, in the state where the linear absorbing member (an absorbing member formed as a linear member) faces the nozzle rows (the state where the absorbing member is disposed in the flying path of the fluid ejected from the nozzles), it is possible to allow the absorbing member to absorb the fluid ejected from the nozzles. In addition, since the absorbing member is formed as the linear absorbing member, it is possible to move the absorbing member to a position retracted from the flying path of the fluid by slightly moving the absorbing member. For this reason, in the fluid ejecting apparatus, it is possible to end a maintenance operation in a short time.

In the fluid ejecting apparatus, the absorbing member may be provided between the fluid ejecting head and the medium. With the above-described configuration, since the absorbing member is disposed between the fluid ejecting head and the medium, it is possible to move the absorbing member to a position retracted from the flying path of the fluid by slightly moving the absorbing member.

In the fluid ejecting apparatus, a maximum sectional dimension of the absorbing member may be equal to or more than 5 times and equal to or less than 75 times a diameter of each of the nozzles.

With the above-described configuration, it is possible to sufficiently ensure a fluid holding amount of the absorbing member, and to sufficiently ensure a fluid receiving area.

In addition, more desirably, a maximum sectional dimension of the absorbing member may be equal to or more than 10 times and equal to or less than 50 times a diameter of each of the nozzles. Accordingly, it is possible to sufficiently ensure a fluid holding amount of the absorbing member, and to sufficiently ensure a fluid receiving area.

A first moving mechanism may be provided which moves the absorbing member in a direction intersecting the extension direction of the nozzle row.

With the above-described configuration, it is possible to simply allow the absorbing member to face the nozzle rows by moving the absorbing member in a direction intersecting the extension direction of the nozzle rows.

In the fluid ejecting apparatus, a second moving mechanism may be provided which moves the absorbing member in the extension direction by a rotation driving operation of a rotation body. For this reason, it is possible to move the absorbing member with a very simple configuration. In addition, it is possible to move a region containing the fluid of the absorbing member and to allow a region not containing the fluid to face the nozzle rows by moving the absorbing member along the extension direction of the nozzle rows. Accordingly, it is possible to reliably absorb the fluid ejected from the nozzles by using the absorbing member during the flushing operation.

In the fluid ejecting apparatus, a configuration may be adopted in which the second moving mechanism is moved by winding the absorbing member.

With the above-described configuration, it is possible to move the absorbing member while collecting the absorbing member.

In the fluid ejecting apparatus, a configuration may be adopted in which the second moving mechanism moves the absorbing member after the flushing operation is performed plural times.

With the above-described configuration, since the same region of the absorbing member receives the fluid plural times, it is possible to allow the absorbing member to absorb a large amount of fluid.

In the fluid ejecting apparatus, a configuration may be adopted in which a second moving mechanism moves the absorbing member during the flushing operation.

With the above-described configuration, since a region not receiving the fluid of the absorbing member always receives the fluid, it is possible to reliably absorb the fluid.

In the fluid ejecting apparatus, the absorbing member is moved by a lead screw and a driving device for rotationally driving the lead screw. For this reason, it is possible to perform the flushing operation with a very simple configuration.

In the fluid ejecting apparatus, the lead screw may include a shaft portion and a convex portion which is helically wound around the shaft portion, and an arrangement pitch of the convex portion in the axial direction of the lead screw may be set to 1/n (n is an integer excluding 1) of an arrangement pitch of the nozzle rows.

With the above-described configuration, it is possible to easily calculate the movement amount of the absorbing member for each rotation of the lead screw, and to simply control the driving device.

In the fluid ejecting apparatus, a configuration may be adopted in which the arrangement pitch of the convex portion in the axial direction of the lead screw is set to ½ of the arrangement pitch of the nozzle rows, and the absorbing member is moved when the lead screw is rotated one turn by the driving device.

With the above-described configuration, it is possible to move the absorbing member between a flushing position and a retraction position just by rotating the lead screw one turn.

In the fluid ejecting apparatus, a configuration may be adopted in which a plurality of the absorbing members is provided, and the absorbing members are wound around the lead screw at an arrangement pitch of the nozzle rows.

With the above-described configuration, it is possible to move the absorbing members for all nozzle rows between the flushing position and the retraction position in the same manner.

In the fluid ejecting apparatus, a configuration may be adopted in which the absorbing member has a circular sectional shape.

With the above-described configuration, even when the absorbing member rotates about the extension direction serving as the axis, a fluid receiving area does not change. For this reason, it is not necessary to consider the posture of the absorbing member in the rotation direction.

In the fluid ejecting apparatus, a configuration may be adopted in which the absorbing member is formed by twisting a plurality of strings.

With the above-described configuration, since the fluid can be accommodated in valley portions formed between plural strings and formed by twisting the strings, it is possible to increase the fluid absorbing amount of the absorbing member.

In the fluid ejecting apparatus, a cleaning mechanism may be provided which cleans the absorbing member.

With the above-described configuration, it is possible to recycle the absorbing member by cleaning the absorbing member absorbing the fluid. Accordingly, it is possible to continuously use the absorbing member, and to reduce the exchange operation or the waste amount.

In addition, a plurality of the nozzle rows may be provided, and the absorbing member may be provided for each of the nozzle rows.

With the above-described configuration, it is possible to absorb and collect the fluid ejected from the nozzle rows during the flushing operation.

BRIEF DESCRIPTION OF THE DRAWINGS

The invention will be described with reference to the accompanying drawings, wherein like numbers reference like elements.

FIG. 11A is a sectional view and FIG. 11B is a side view.

DESCRIPTION OF EXEMPLARY EMBODIMENTS

Hereinafter, exemplary embodiments of the invention will be described with reference to the accompanying drawings. In addition, in the respective drawings used in the following description, the scales of the respective constituents are appropriately modified in order to allow the respective constituents to have the recognizable sizes.

First Embodiment

A fluid ejecting apparatus according to a first embodiment of the invention will be described. In this embodiment, an ink jet printer (hereinafter, simply referred to as a printer) is exemplified as the fluid ejecting apparatus.

Figure 1:
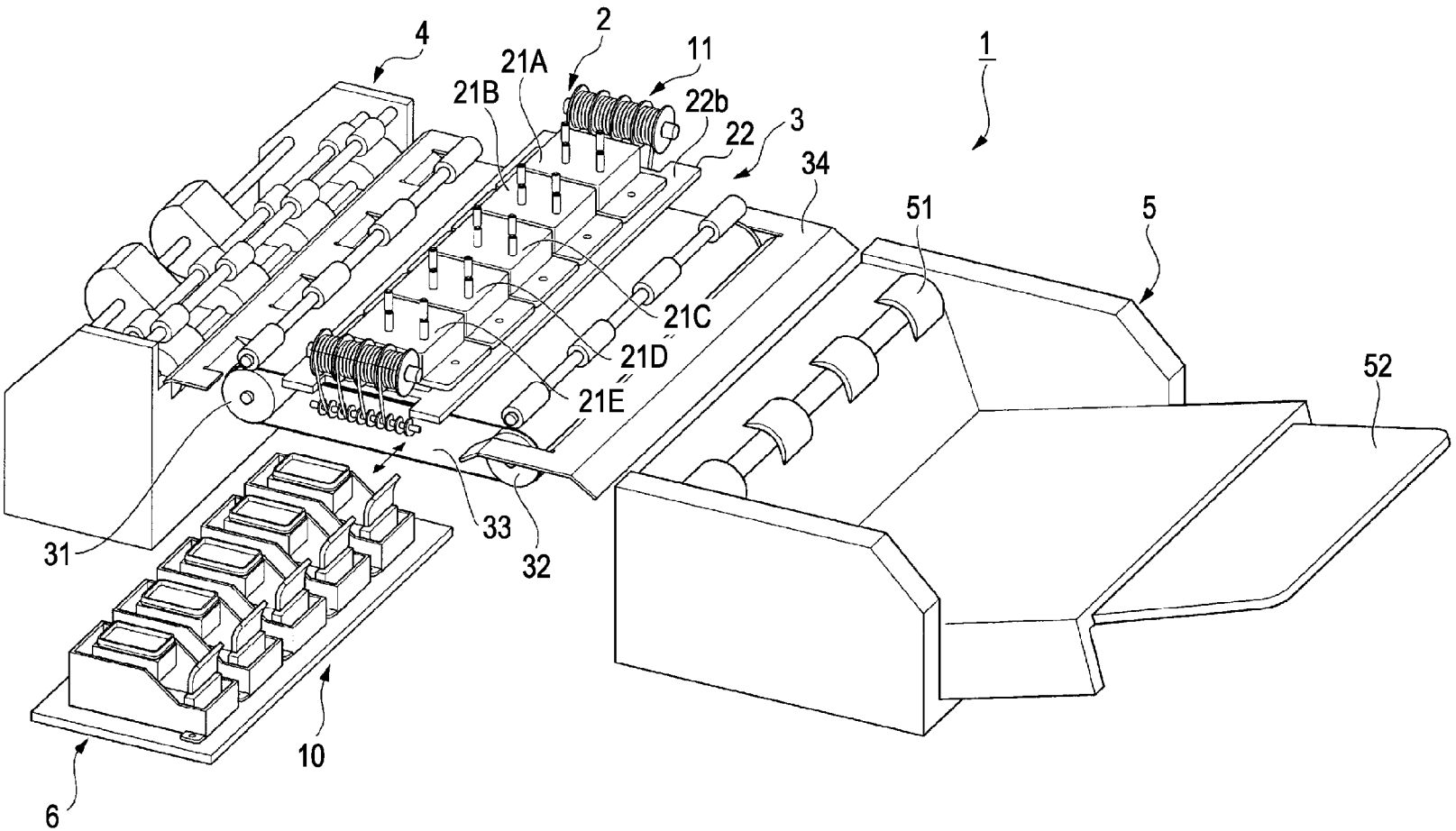
FIG. 1 is a perspective view illustrating a schematic configuration of a printer according to a first embodiment of the invention.
Figure 2:
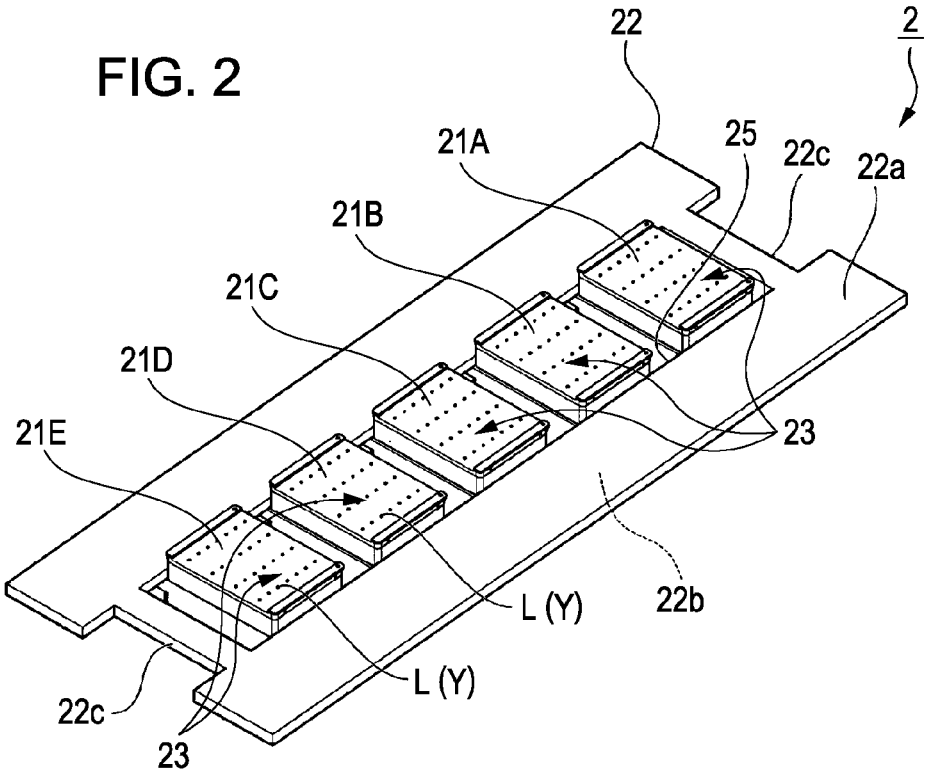
FIG. 2 is a perspective view illustrating a schematic configuration of a head unit according to the first embodiment.
Figure 3:
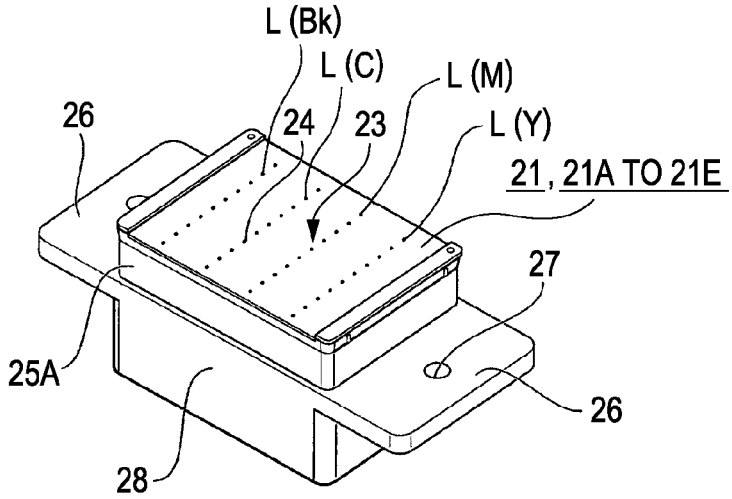
FIG. 3 is a perspective view illustrating a schematic configuration of a printing head according to the first embodiment.
Figure 4:
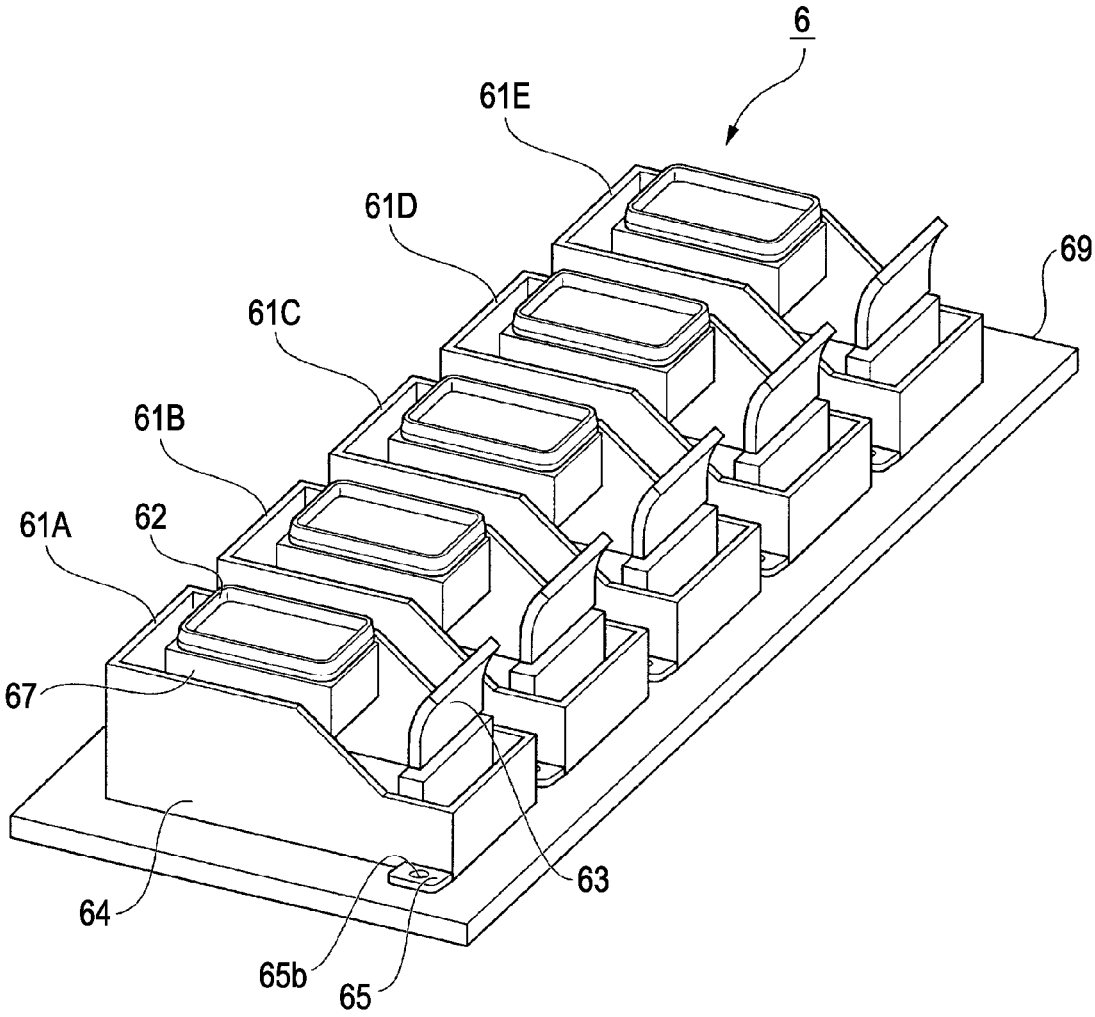
FIG. 4 is a perspective view illustrating a schematic configuration of a cap unit according to the first embodiment.

FIG. 1 is a perspective view illustrating a schematic configuration of the printer. FIG. 2 is a perspective view illustrating a schematic configuration of a head unit. FIG. 3 is a perspective view illustrating a schematic configuration of a printing head constituting the head unit. FIG. 4 is a perspective view illustrating a schematic configuration of a cap unit.

As shown in FIG. 1, a printer 1 includes: a head unit 2; a transporting device 3 which transports a printing sheet (medium); a sheet feeding unit 4 which supplies the printing sheet; a sheet discharging unit 5 which discharges the printing sheet having been subjected to a printing operation of the head unit 2; and a maintenance device 10 which performs a maintenance operation on the head unit 2.

The transporting device 3 is adapted to hold the printing sheet while maintaining a predetermined gap between the printing sheet and nozzle surfaces 23 of printing heads 21 (21A, 21B, 21C, 21D, and 21E) constituting the head unit 2. The transporting device 3 includes a driving roller portion 31, a driven roller portion 32, and a transporting belt portion 33 which has plural belts suspended between the roller portions 31 and 32. In addition, a holding member 34 is provided between the sheet discharging unit 5 and the downstream portion of the transporting device 3 (on the side of the sheet discharging unit 5) in the sheet transporting direction so as to hold the printing sheet.

One end of the driving roller portion 31 in the rotation direction is connected to a driving motor (not shown), and is rotationally driven by the driving motor. The rotation force of the driving roller portion 31 is transmitted to the transporting belt portion 33, so that the transporting belt portion 33 is rotationally driven. If necessary, a transmission gear is provided between the driving roller portion 31 and the driving motor. The driven roller portion 32 is a so-called free roller which supports the transporting belt portion 33 and is rotated by the rotational driving operation of the transporting belt portion 33 (the driving roller portion 31).

The sheet discharging unit 5 includes a sheet discharging roller 51 and a sheet discharging tray 52 which holds the printing sheet transported by the sheet discharging roller 51.

The head unit 2 is formed as a unit including plural (in this embodiment, five) printing heads 21A to 21E, and plural colors of ink (for example, ink having colors of black B, magenta M, yellow Y, and cyan C) is adapted to be ejected from nozzles 24 (see FIG. 3) of the printing heads 21A to 21E. The printing heads 21A to 21E (hereinafter, referred to as the printing heads 21 in some cases) are formed as a unit which is attached to an attachment plate 22. That is, the head unit 2 according to this embodiment constitutes a line head module which has plural combinations of printing heads 21 (single head member) and in which an effective printing width of the head unit 2 is substantially equal to the transverse width (the width perpendicular to the sheet transporting direction) of the printing sheet. In addition, the printing heads 21A to 21E have the same structure.

As shown in FIG. 2, the head unit 2 has a configuration in which the printing heads 21A to 21E are arranged inside an opening 25 formed in the attachment plate 22. In detail, the printing heads 21A to 21E are screw-fixed to a rear surface 22*b* of the attachment plate 22 so that the nozzle surfaces 23 protrude toward a front surface 22*a* of the attachment plate 22 through the opening 25. In addition, the head unit 2 is mounted onto the printer 1 by fixing the attachment plate 22 to a carriage (not shown).

The head unit 2 according to this embodiment is adapted to be movable between a printing position and a maintenance position (in a direction depicted by the arrow in FIG. 1) by the carriage (not shown). Here, the printing position is a position which faces the transporting device 3 and in which a printing operation is performed on the printing sheet. Meanwhile, the maintenance position is a position in which the head unit 2 is retracted to the transporting device 3 and which faces a maintenance device 10. In the maintenance position, a maintenance operation (a suction operation and a wiping operation) is performed on the head unit 2.

As shown in FIG. 3, each of the printing heads 21A to 21E (hereinafter, simply referred to as the printing head 21 in some cases) constituting the head unit 2 includes a head body 25A which has the nozzle surface 23 having nozzle rows L formed by plural nozzles 24 and a support member 28 onto which the head body 25A is mounted.

Each of the printing heads 21A to 21E has four nozzle rows (L(Y), L(M), L(C), and L(Bk)) corresponding to four colors (yellow (Y), magenta (M), cyan (C), and black (Bk)). In the nozzle rows (L(Y), L(M), L(C), and L(Bk)), the nozzles 24 constituting the nozzle rows (L(Y), L(M), L(C), and L(Bk)) are arranged in the horizontal direction perpendicular to the sheet transporting direction, and more suitably, are arranged in the horizontal direction perpendicular to the sheet transporting direction. In addition, in the direction where the printing heads 21A to 21E are arranged, the nozzle rows L having the same color are aligned to each other.

Protrusion portions 26 and 26 are formed on both sides of the support member 28 in the longitudinal direction of the nozzle surface 23. In addition, each of the protrusion portions 26 and 26 is provided with a perforation hole 27 which is used to screw-fix the printing head 21 to the rear surface 22*b* of the attachment plate 22. Accordingly, the head unit 2 is obtained in which the plural printing heads 21 are attached to the attachment plate 22 (see FIG. 1).

The maintenance device 10 includes a cap unit 6 which performs the suction operation on the head unit 2 and a flushing unit 11 which performs the flushing operation on the head unit 2.

As shown in FIG. 4, the cap unit 6 is a unit which performs the maintenance operation on the head unit 2 and includes plural (in this embodiment, five) cap portions 61A to 61E respectively corresponding to the printing heads 21A to 21E. The cap unit 6 is disposed at a position deviated from the printing area of the head unit 2. Here, the cap unit 6 is disposed at a position not facing the transporting device 3.

The cap portions 61A to 61E respectively correspond to the printing heads 21A to 21E, and are adapted to respectively come into contact with the nozzle surfaces 23 of the printing heads 21A to 21E. Since the cap portions 61A to 61E respectively come into close contact with the nozzle surfaces 23 of the printing heads 21A to 21E, in the suction operation, it is possible to satisfactorily perform the suction operation in which ink (fluid) is ejected from each of the nozzle surfaces 23.

Each of the cap portions 61A to 61E (hereinafter, simply referred to as a cap portion 61 in some cases) constituting the cap unit 6 includes: a cap body 67; a seal member 62 which is formed on the upper surface of the cap body 67 so as to have a frame shape and comes into contact with the printing head 21; a wiper member 63 which is used in the wiping operation of wiping the nozzle surface 23 of the printing head 21; and a casing portion 64 which integrally retains the cap body 67 and the wiper member 63.

The bottom portion of the casing portion 64 is provided with two holding portions 65 (here, one of them is not shown in the drawing) which are used to hold the casing portion 64 in a base member 69. The holding portions 65 are disposed in the casing portion 64 so as to have a diagonal relationship therebetween in a plan view. Each of the holding portions 65 is provided with a perforation hole 65*b* into which a screw is inserted so as to screw-fix the casing portion 64 to the base member 69.

Figure 5A:
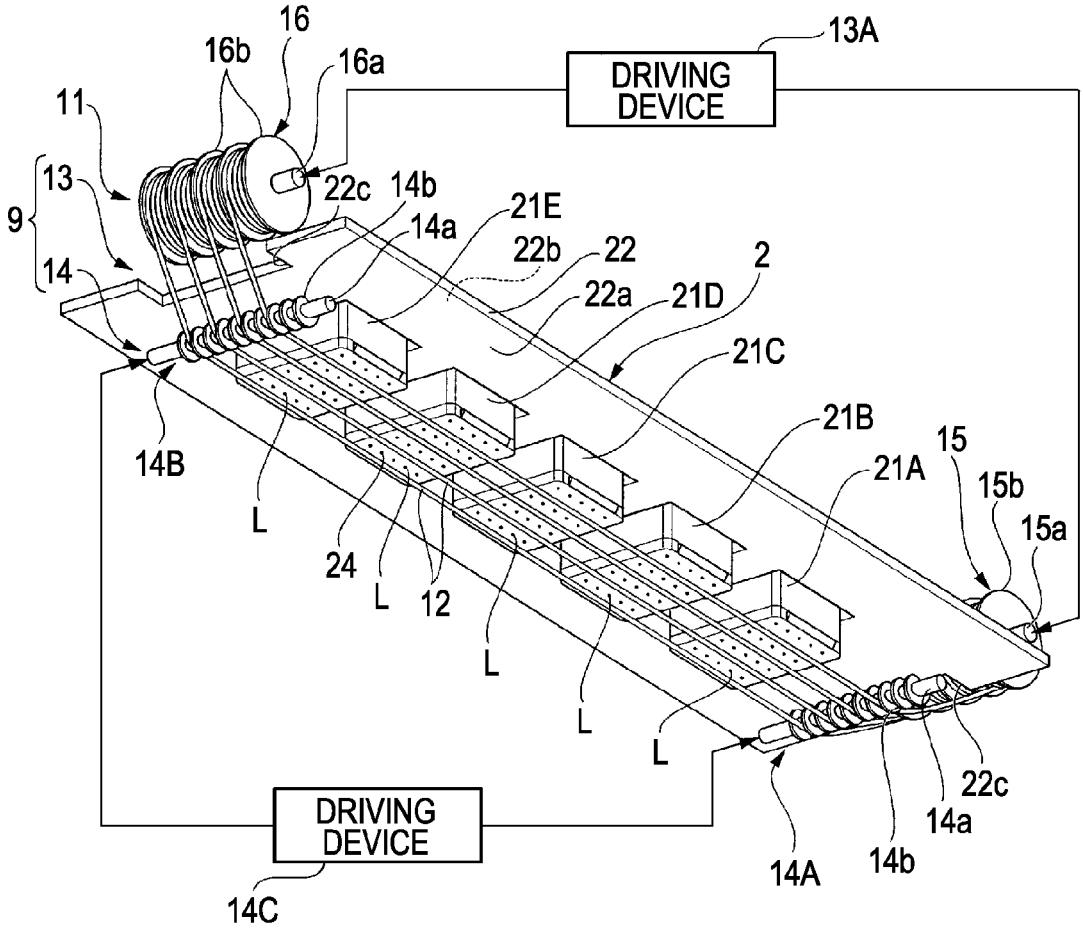
FIGS. 5A and 5B are perspective views illustrating a schematic configuration of a flushing unit according to the first embodiment.
Figure 5B:
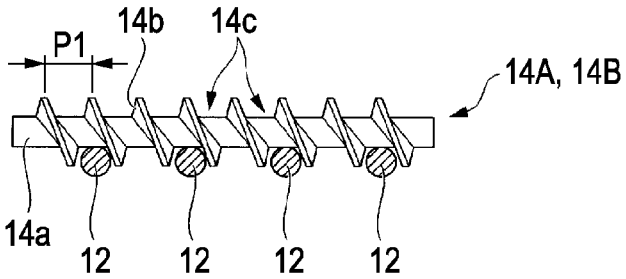

As shown in FIGS. 5A and 5B, the flushing unit 11 includes plural absorbing members 12 which absorb ink droplets ejected during the flushing operation and a support mechanism 9 which supports the plural absorbing members 12.

As shown in FIGS. 5A and 5B, four absorbing members 12 are provided for each head unit 2 and are formed as linear members which absorb ink droplets ejected from the nozzles 24. The absorbing members 12 are disposed so as to respectively extend along the nozzle rows (L(Y), L(M), L(C), and L(Bk)) formed by plural colors of nozzles 24, and are located in a sheet transporting region between the nozzle surfaces 23 and the printing sheet. Each of the absorbing members 12 is formed of, for example, a string material or the like. As a material of the absorbing member 12, chemical fiber having a surface subjected to a hydrophobic treatment is exemplified, and a material capable of efficiently absorbing and holding ink is desirable. In addition, the absorbing member 12 has a width 5 to 75 times larger than the nozzle diameter. In a general printer, assuming that a gap between the printing sheet and the nozzle surfaces 23 of the printing heads 21A to 21E is about 2 mm, and the nozzle diameter is about 0.02 mm, when the absorbing member 12 has a diameter of 1 mm or less, the absorbing member 12 is able to be disposed between the printing sheet and the nozzle surfaces, and is able to absorb the ejected ink droplets even when the constituents have a certain degree of a tolerance. For this reason, it is desirable that the absorbing member 12 is 10 to 50 times larger than the nozzle diameter. In addition, the absorbing member 12 will be described in detail as below.

In addition, it is desirable that the absorbing member 12 has a length enough for the effective printing width of the head unit 2. Although it is described later in detail, the printer 1 according to this embodiment has a configuration in which the used region (ink absorption region) of the absorbing member 12 is sequentially wound, and the absorbing member 12 is exchanged in the case where ink is absorbed by the entire region of the absorbing member 12. For this reason, it is desirable that the exchange time of the absorbing member 12 is a practical exchange time and the length of the absorbing member 12 is about several hundreds of times longer than the effective printing width of the head unit 2. However, in the case where the absorbing member 12 is recycled by a cleaning operation inside the printer 1, the length of the absorbing member 12 may be about two times longer than the effective printing width of the head unit 2.

In addition, the absorbing member 12 is supported by the support mechanism 9.

The support mechanism 9 includes a moving mechanism 13 (second moving mechanism) and a moving mechanism 14 (first moving mechanism). The support mechanism 9 is substantially integrated with the head unit 2.

The moving mechanism 14 moves the absorbing member 12 between a flushing position facing the nozzle 24 and a retraction position not facing the nozzle 24 by moving the absorbing member 12 in a direction intersecting (in this embodiment, a direction perpendicular to) the extension direction of the nozzle row. In addition, the moving mechanism 13 moves along the extension direction of the nozzle row by running the absorbing member 12.

As shown in FIGS. 1 and 5A, the moving mechanism 13 includes rotation portions 15 and 16 (rotation bodies) which are provided on both sides of the head unit 2 in the extension direction of the nozzle row and has rotation shafts provided on the side of the rear surface 22*b* (on the opposite side of the nozzle surfaces 23 of the heads 21A to 21E) of the attachment plate 22 so as to be parallel to the sheet transporting direction. The rotation portions 15 and 16 are bobbin-shaped winding mechanisms which respectively include the rotation shafts 15*a* and 16*a* and plural (here, five) partitioning plates 15*b* and 16*b* disposed in the rotation shafts 15*a* and 16*a* so as to have the same interval therebetween. The rotation portions 15 and 16 are adapted to move in the extension direction of the nozzle row by winding four absorbing members 12 around the rotation shafts 15*a* and 16*a* so that each of the absorbing members 12 is located between the partitioning plates 15*b* and 16*b*. When the absorbing members 12 are wound in this manner, it is possible to collect the absorbing members 12 while moving the absorbing members 12. Accordingly, it is possible to easily exchange the absorbing members 12 just by exchanging the rotation portions 15 and 16 when the absorbing members 12 cannot be wound any more.

In addition, as shown in FIGS. 5A and 5B, the moving mechanism 13 includes a driving device 13A which rotationally drives the rotation portions 15 and 16. The rotation portions 15 and 16 are connected to the driving device 13A, and are rotated so as to respectively supply and wind the plural absorbing members 12. In this embodiment, one rotation portion 15 is used to supply the absorbing members 15 and the other rotation portion 16 is used to wind the absorbing members 15.

Likewise, in the printer 1 according to this embodiment, the moving mechanism 13 moves the absorbing members 12 in the extension direction by rotationally driving the rotation portions 15 and 16.

As shown in FIGS. 5A and 5B, the moving mechanism 14 includes a pair of moving members 14A and 14B (lead screw) each having a configuration in which a convex portion 14*b* is helically wound around a shaft portion 14*a*, and each of the absorbing members 12 is wound around a guide groove 14*c* formed by the shaft portion 14*a* and the convex portion 14*b*. The moving mechanism 14 is disposed on both sides of the head unit 2 in the nozzle row direction so as to be located on the side of the front surface 22*a* of the attachment plate 22 (the nozzle surfaces 23 of the printing heads 21A to 21E). The plural absorbing members 12 wound around the rotation portions 15 and 16 of the moving mechanism 13 are suspended between the moving members 14A and 14B. In addition, the end of the guide groove 14*c* in a direction perpendicular to the nozzle surface 23 and the nozzle surface 23 has a positional relationship in which the end thereof is located in a direction distant from the nozzle surface 23. For this reason, it is possible to maintain the absorbing members 12 suspended on the moving members 14A and 14B so as not to come into contact with the nozzle surfaces 23 of the printing heads 21A to 21E.

In addition, as shown in FIG. 5B, in the printer 1 according to the embodiment, when seen from the axial direction of the moving members 14A and 14B, an arrangement pitch P1 of the convex portion 14*b* is set to ½ (1/integer excluding 1) of an arrangement pitch P2 (see FIGS. 6A and 6B) of the nozzle rows. Accordingly, an arrangement pitch of the guide grooves 14*c* is set to ½ of the arrangement pitch P2 (see FIGS. 6A and 6B) of the nozzle rows. Likewise, since the arrangement pitch P1 of the convex portion 14*b* is set to ½ of the arrangement pitch P2 of the arrangement pitch of the nozzle rows, when the moving members 14A and 14B rotate one turn, it is possible to move the absorbing members 12 by a distance corresponding to ½ of the arrangement pitch P2 of the nozzle rows, and to move the absorbing members 12 between the flushing position and the retraction position to be described later without delicately controlling the number of the rotation of the moving members 14A and 14B.

Further, in the printer 1 according to this embodiment, although four absorbing members 12 are suspended between the moving members 14A and 14B, since each of the absorbing members 12 is disposed in each of the guide grooves 14*d*, each of the absorbing members 12 is directly suspended between the moving members 14A and 14B every arrangement pitch P2 of the nozzle rows. For this reason, it is possible to move all absorbing members 12 between the flushing position and the retraction position in the same manner in all nozzle rows.

As shown in FIGS. 5A and 5B, the moving mechanism 14 includes a driving device 14C which rotationally drives the moving members 14A and 14B. As described above, the absorbing members 12 move between the flushing position and the retraction position when the moving members 14A and 14B are rotated one turn. For this reason, the driving device 14C rotationally drives the moving members 14A and 14B so as to be rotated one turn in response to each command. For this reason, it is very easy to control the driving device 14C of the printer 1 according to this embodiment.

The absorbing members 12 suspended between the moving members 14A and 14B are wound around the rotation portions 15 and 16 through notch portions 22*c* and 22*c* formed in the attachment plate 22 so as not to come into contact with the attachment plate 22. Accordingly, it is possible to smoothly move the absorbing members 12.

In addition, since each rotation speed of the rotation portions 15 and 16 is controlled by a control device (not shown), the support mechanism 9 supports the plural absorbing members 12 supported to the moving mechanisms 13 and 14 while maintaining an appropriate tension so that the absorbing members 12 are not bent. Accordingly, it is possible to prevent the absorbing members 12 from being bent and from coming into contact with the nozzle surfaces 23 or the printing sheet.

In the support mechanism 9, since the plural absorbing members 12 are supported by the rotation portions 15 and 16 disposed on the side of the rear surface 22*b* of the attachment plate 22 of the head unit 2 and by the moving members 14A and 14B disposed on the side of the front surface 22*a* of the attachment plate 22, the absorbing members 12 supplied from the rotation portion 15 are adapted to be wound around the rotation portion 16 through the nozzle surfaces 23 of the printing heads 21A to 21E. For this reason, the absorbing members 12 are adapted to move in the extension direction of each nozzle row L of the head unit 2, that is, a direction intersecting the sheet transporting direction in accordance with the rotation of the rotation portions 15 and 16.

In addition, when the moving members 14A and 14B are rotated by the driving device 14C, it appears that the plural guide grooves 14*c* formed by the shaft portion 14*a* and the convex portion 14*b* move along the axial direction. Accordingly, it is possible to change the position of each of the absorbing members 12 with respect to the head unit 2 (nozzle row L). In detail, it is possible to move the absorbing members 12 in a direction intersecting the extension direction of the nozzle row L of the head unit 2, that is, the sheet transporting direction. In this embodiment, the absorbing members 12 move between the flushing position and the retraction (printing) position. Here, when the diameter of each of the absorbing members 12 is set to 1 mm, the absorbing member 12 may move by 1 mm even when there is a tolerance in the constituent or the arrangement. When the gap of the convex portion 14*b* is set to 1 mm, since the absorbing member moves by 1 mm upon rotating the moving member one turn, it is possible to easily and highly precisely move the plural absorbing members 12. In addition, since the absorbing member moves by only 1 mm, the time for the movement of the absorbing member is short. Further, since the distance between the printing head 21 and the printing sheet is 2 mm, and the absorbing members 12 are disposed therebetween so as to have a tension, it is not necessary to move the printing head 21 and the printing sheet during the movement of the absorbing member.

Figure 6A:
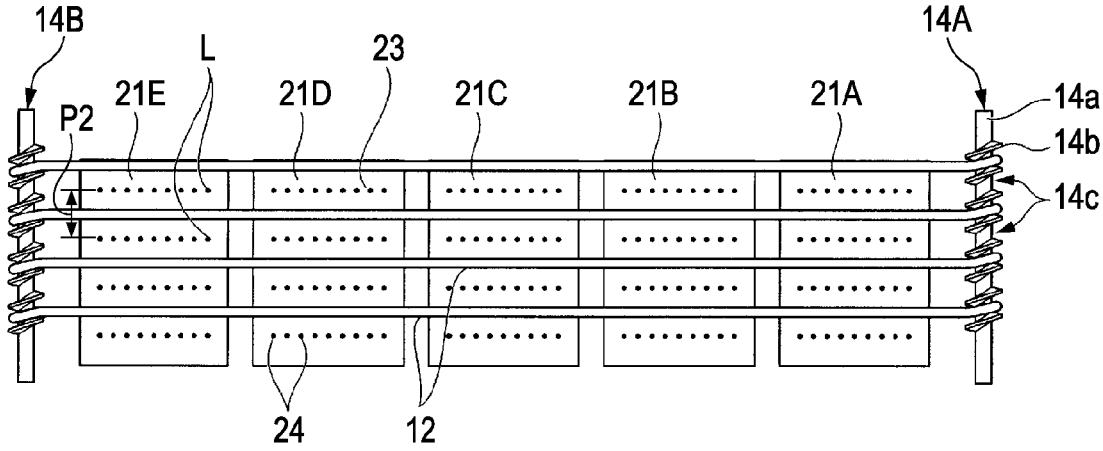
FIGS. 6A and 6B are plan views illustrating a moving position of an absorbing member according to the first embodiment.
Figure 6B:
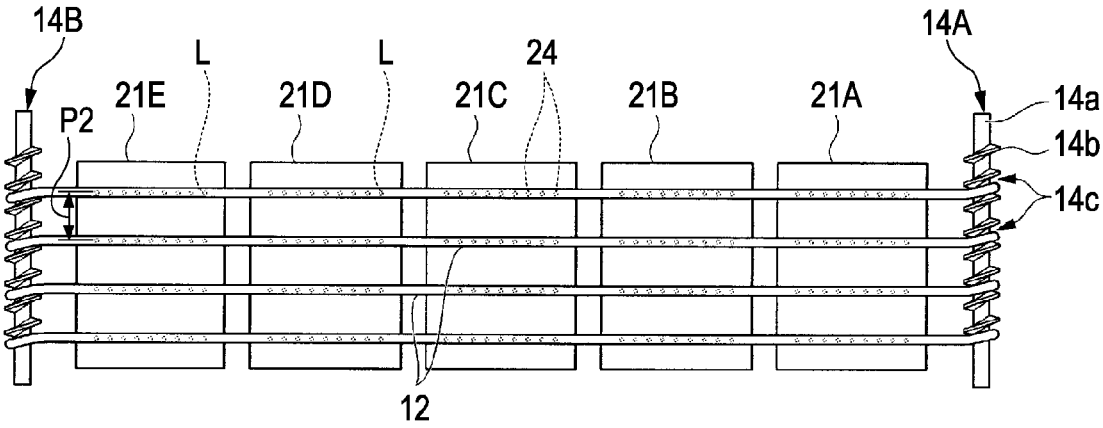

Here, as shown in FIG. 6B, the flushing position is a position where the absorbing members 12 respectively face the corresponding plural nozzle rows L (the plural nozzles 24 constituting the nozzle rows L) so as to absorb the ink droplets ejected from the nozzle rows L during the flushing operation. Meanwhile, as shown in FIG. 6A, the retraction position of the absorbing member 12 is a position where the absorbing members 12 do not face the nozzle rows L (the plural nozzles 24 constituting the nozzle rows L) so as not to absorb the ink droplets used for the printing operation and ejected from the nozzles 24 during the printing operation.

As shown in FIGS. 6A and 6B, when the moving members 14A and 14B are rotated, all the absorbing members 12 move. In addition, the absorbing members 12 in the printer 1 according to this embodiment are disposed between the nozzle surfaces of the head 21 and the printing sheet in the sheet transporting direction regardless of the flushing position and the retraction position.

Further, in FIG. 1, only one pair of a head module 2, a maintenance device 10, and a flushing unit 12 is shown. However, in fact, another pair of the head module 2, the maintenance device 10, and the flushing unit 12 is disposed in the sheet transporting direction. The two pairs of them have the same configuration in mechanism, but are disposed to be deviated from each other in the horizontal direction (the arrangement direction of the heads 21A to 21E) perpendicular to the sheet transporting direction. In more detail, when seen from the sheet transporting direction, the heads 21A to 21E of the head module 2 of the second pair are disposed between the heads 21A to 21E included in the head module 2 of the first pair. Likewise, since two pairs of the head module 2, the maintenance device 10, and the flushing unit 12 are disposed to be deviated from each other in the horizontal direction perpendicular to the sheet transporting direction, the heads 21A to 21E are disposed in a zigzag shape as a whole, and are capable of ejecting ink to the entire region of the effective printing width.

However, in the case where the heads 21A to 21E are disposed in series in a direction perpendicular to the sheet transporting direction, only one pair of the head module 2, the maintenance device 10, and the flushing unit 12 may be provided. In this case, since a sufficient gap is not formed between the heads 21A to 21E, it is difficult to provide the cap portions 61A to 61E included in the maintenance device 10 so as to respectively correspond to the heads 21A to 21E. For this reason, it is desirable to use a single cap portion capable of surrounding the nozzles 24 of all heads 21A to 21E.

Next, the detailed configuration of the absorbing member 12 suitably used in the printer 1 according to this embodiment will be described.

For example, the absorbing member 12 may be formed of fiber such as SUS 304, nylon, nylon applied with a hydrophobic coating, aramid, silk, cotton, polyester, ultrahigh molecular weight polyethylene, polyarylate, or Zylon (product name), or compound fiber containing a plurality of them.

In more detail, it is possible to form the absorbing member 12 in such a manner that plural fiber bundles formed by the fiber or the compound fiber are twisted or bound.

Figure 8A:
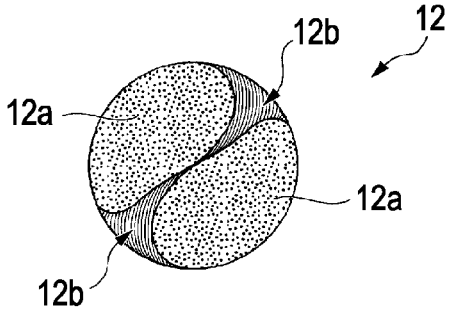
FIGS. 8A and 8B are schematic diagrams illustrating the absorbing member included in the printer according to the first embodiment.
Figure 8B:
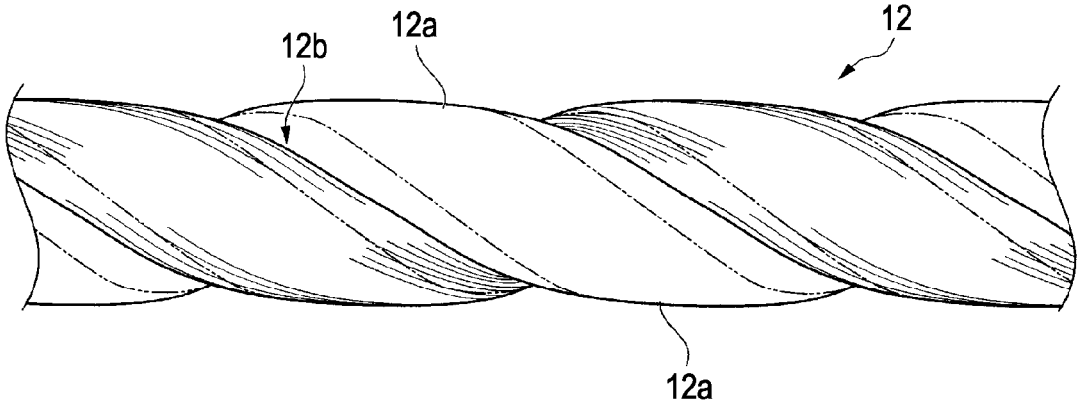

FIGS. 8A and 8B are schematic diagrams showing an example of the absorbing member 12, where FIG. 8A is a sectional view and FIG. 8B is a plan view. As shown in FIGS. 8A and 8B, for example, the absorbing member 12 is formed in such a manner that two (plural) fiber bundles (strings) 12*a* formed by fiber are twisted. As shown in FIGS. 8A and 8B, in the case where the absorbing member 12 is formed by twisting the plural fiber bundles 12*a*, since it is possible to store ink in a valley portion 12*b* formed between the fiber bundles 12*a*, it is possible to increase an ink absorption amount of the absorbing member 12.

In addition, as an example, a linear member obtained by twisting plural fiber bundles formed by SUS 304, a linear member obtained by twisting plural fiber bundles formed by nylon, a linear member obtained by twisting plural fiber bundles formed by nylon applied with hydrophobic coating, a linear member obtained by twisting plural fiber bundles formed by aramid, a linear member obtained by twisting plural fiber bundles formed by silk, a linear member obtained by twisting plural fiber bundles formed by cotton, a linear member obtained by twisting plural fiber bundles formed by Belima (product name), a linear member obtained by twisting plural fiber bundles formed by Soierion (product name), a linear member obtained by twisting plural fiber bundles formed by Hamilon 03T (product name), a linear member obtained by twisting plural fiber bundles formed by Dyneema hamilon DB-8 (product name), a linear member obtained by twisting plural fiber bundles formed by Vectran hamilon VB-30, a linear member obtained by twisting plural fiber bundles formed by Hamilon S-5 Core Kevlar Sleeve Polyester (product name), a linear member obtained by twisting plural fiber bundles formed by Hamilon S-212 Core Coupler Sleeve Polyester (product name), a linear member obtained by twisting plural fiber bundles formed by Hamilon SZ-10 Core Zylon Sleeve Polyester (product name), or a linear member obtained by twisting plural fiber bundles formed by Hamilon VB-3 Vectran (product name) may be suitably used as the absorbing member 12.

Since the absorbing member 12 obtained by the fiber of nylon is formed by nylon widely used as a general leveling string, the absorbing member 12 is cheap.

Since the absorbing member 12 obtained by the metallic fiber of SUS has an excellent corrosion resistance property, it is possible to allow the absorbing member 12 to absorb a variety of ink. Also, since the absorbing member 12 has an excellent wear resistance property compared with a resin, it is possible to repeatedly use the absorbing member 12.

The absorbing member 12 obtained by the fiber of ultrahigh molecular weight polyethylene has high breaking strength and chemical resistance, and is strong against an organic solvent, acid, or alkali. Likewise, since the absorbing member 12 obtained by the fiber of ultrahigh molecular weight polyethylene has high breaking strength, it is possible to pull the absorbing member 12 in a high-tension state, and to prevent the absorbing member 12 from being bent. For this reason, in the case where the diameter of the absorbing member 12 is thickened so as to increase the absorbing capacity or the diameter of the absorbing member 12 is not thickened, it is possible to improve the printing precision by narrowing the distance between the printing sheet transporting region and the heads 21A to 21E. In addition, it is expected that the above-described advantage is obtained even in the absorbing member 12 obtained by the fiber of Zylon or aramid and the absorbing member 12 obtained by the fiber of super-high-molecular polyethylene.

The absorbing member 12 obtained by the fiber of cotton has an excellent ink absorbing property.

In the absorbing member 12, the dropped ink is accommodated and absorbed in the valley portion 12*b* (see FIGS. 8A and 8B) formed between the fiber bundle 12*a* and the fiber due to the surface tension.

In addition, a part of the ink dropped onto the surface of the absorbing member 12 directly enters into the absorbing member 12, and the rest moves to the valley portion 12*b* formed between the fiber bundles 12*a*. Further, a part of the ink entering into the absorbing member 12 gradually moves in the extension direction of the absorbing member 12 in the inside of the absorbing member 12 so as to be held therein while being dispersed in the extension direction of the absorbing member 12. A part of the ink moving to the valley portion 12*b* of the absorbing member 12 gradually enters into the absorbing member 12 through the valley portion 12*b*, and the rest remains in the valley portion 12*b* so as to be held therein while being dispersed in the extension direction of the absorbing member 12. That is, a part of the ink dropped onto the surface of the absorbing member 12 stays at the dropped position, and the rest is dispersed and absorbed in the vicinity of the dropped position.

In addition, in fact, a material forming the absorbing member 12 provided in the printer 1 is selected in consideration of an ink absorbing property, an ink holding property, a tension strength, an ink resistance property, formability (a generation amount of fluff or scattering), distortion, a cost, or the like.

Further, the ink absorbing amount of the absorbing member 12 is the sum of the amount of ink held between the fibers of the absorbing member 12 and the amount of ink held in the valley portion 12*b*. For this reason, the material forming the absorbing member 12 is selected so that the ink absorbing amount is sufficiently larger than the amount of the ink ejected during the flushing operation in consideration of the exchange frequency of the absorbing member 12.

Furthermore, the amount of ink held between the fibers of the absorbing member 12 and the amount of ink held in the valley portion 12*b* may be determined by the contact angle between the ink and the fiber, and the capillary force between the fibers depending on the surface tension of the ink. That is, when the absorbing member 12 is formed by thin fibers, the gap between the fibers increases and the surface area of the fiber increases. Accordingly, even when the sectional area of the absorbing member 12 is uniform, the absorbing member 12 is capable of absorbing a larger amount of ink. As a result, in order to obtain more gaps between the fibers, a micro fiber (ultrafine fiber) may be used as a fiber forming the fiber bundle 12*a*.

However, the ink holding force of the absorbing member 12 decreases since the capillary force decreases due to an increase in gap between the fibers. For this reason, it is necessary to set the gap between the fibers so that the ink holding force of the absorbing member 12 is equal to a degree that the ink is not dropped due to the movement of the absorbing member 12.

In addition, the thickness of the absorbing member 12 is set so as to satisfy the above-described ink absorbing amount. In detail, for example, the thickness of the absorbing member 12 is set to be equal to or more than 0.2 mm and equal to or less than 1.0 mm, and more desirably about 0.5 mm.

However, in order to prevent the absorbing member 12 from coming into contact with the heads 21A to 21E and the printing sheet, the thickness of the absorbing member 12 is set so that the maximum dimension of the section is equal to or less than a dimension obtained by subtracting an amount excluding the displacement amount caused by the bending of the absorbing member 12 from the distance of the sheet transporting region between the printing sheet and the heads 21A to 21E.

In fact, the maximum dimension of the section of the absorbing member 12 may be set to be equal to or more than 5 times and equal to or less than 75 times the diameter of the nozzle 24. In the case where the maximum dimension of the section of the absorbing member 12 is 5 times smaller than the diameter of the nozzle 24, it is difficult to manufacture the too thin absorbing member 12. In the case where the maximum dimension of the section of the absorbing member 12 is 75 times larger than the diameter of the nozzle 24, the absorbing member 12 is easily bent due to an increase in weight upon absorbing the fluid.

In addition, the section of the absorbing member 12 may not be formed in a circular shape, but may be formed in a polygonal shape.

However, if the section of the absorbing member is formed in a circular shape, even when the absorbing member 12 rotates about the extension direction as the rotation axis, the ink receiving area does not change. For this reason, it is not necessary to consider the posture of the rotation direction of the absorbing member 12. Here, since it is difficult to form the absorbing member in a perfect circular shape, the absorbing member may be formed in a circular shape or a substantially circular shape.

In addition, in the case where the section of the absorbing member 12 is formed in a circular shape, it is desirable that the maximum dimension of the section of the absorbing member 12 is equal to or more than 10 times and equal to or less than 50 times the diameter of the nozzle 24. Accordingly, it is possible to sufficiently ensure the ink holding amount of the absorbing member 12, and to sufficiently ensure the ink receiving area.

In the printer 1 having the above-described configuration, during the printing operation in which ink is ejected from the heads 21A to 21E onto the printing sheet, not all of the nozzles 24 eject ink. For this reason, the ink inside the nozzles 24 not ejecting the ink is dried, and hence clay increases. When the ink is thickened, it is not possible to eject a desired amount of ink. Accordingly, it is necessary to perform the flushing operation in which the ink is periodically ejected on the absorbing member 12 so as to prevent the ink from being thickened.

In addition, the absorbing member 12 included in the printer 1 according to this embodiment is located at the retraction position where the absorbing member 12 is deviated from the lower portion of the nozzle 24 upon performing the printing operation on the printing sheet, and is located at the flushing position where the absorbing member 12 is disposed right below the nozzle 24 upon performing the flushing operation. That is, since the absorbing member 12 is located right below the nozzle 24 upon performing the flushing operation, the printing operation cannot be performed, and thus the printing operation needs to be stopped. For this reason, it is desirable that the flushing operation is performed when a gap between the transported printing sheets is located right below the nozzle. In a so-called line head printer such as the printer 1 according to this embodiment, since the printing operation is performed on 60 sheets of printing sheets per minute, a gap between the printing sheets is located right below the nozzle every 5 second. Accordingly, in the printer 1 according to this embodiment, for example, the flushing operation is performed every 5 second or 10 second.

Further, in the case where the printing operation is continuously performed on plural sheets of printing sheets, the time during which a gap between the printing sheets is located right below the nozzle 24 is a very short time. In the known printer, the movement of the head unit or the absorbing member for the flushing operation is large. For this reason, in the known printer 1, since the flushing operation cannot be completely performed for the short time, the operation of transporting the printing sheet is temporarily stopped, and hence the stop time decreases the number of printing sheets per hour. On the contrary, in the printer 1 according to this embodiment, it is possible to selectively perform the printing operation and the flushing operation just by moving the absorbing member 12 in the very narrow region right below the heads 21A to 21E. Also, it is possible to completely perform the flushing operation during a time when a gap between the printing sheets is located right below the nozzle 24, or to shorten a time during which the printing sheet transporting operation is stopped for the flushing operation.

Figure 9:
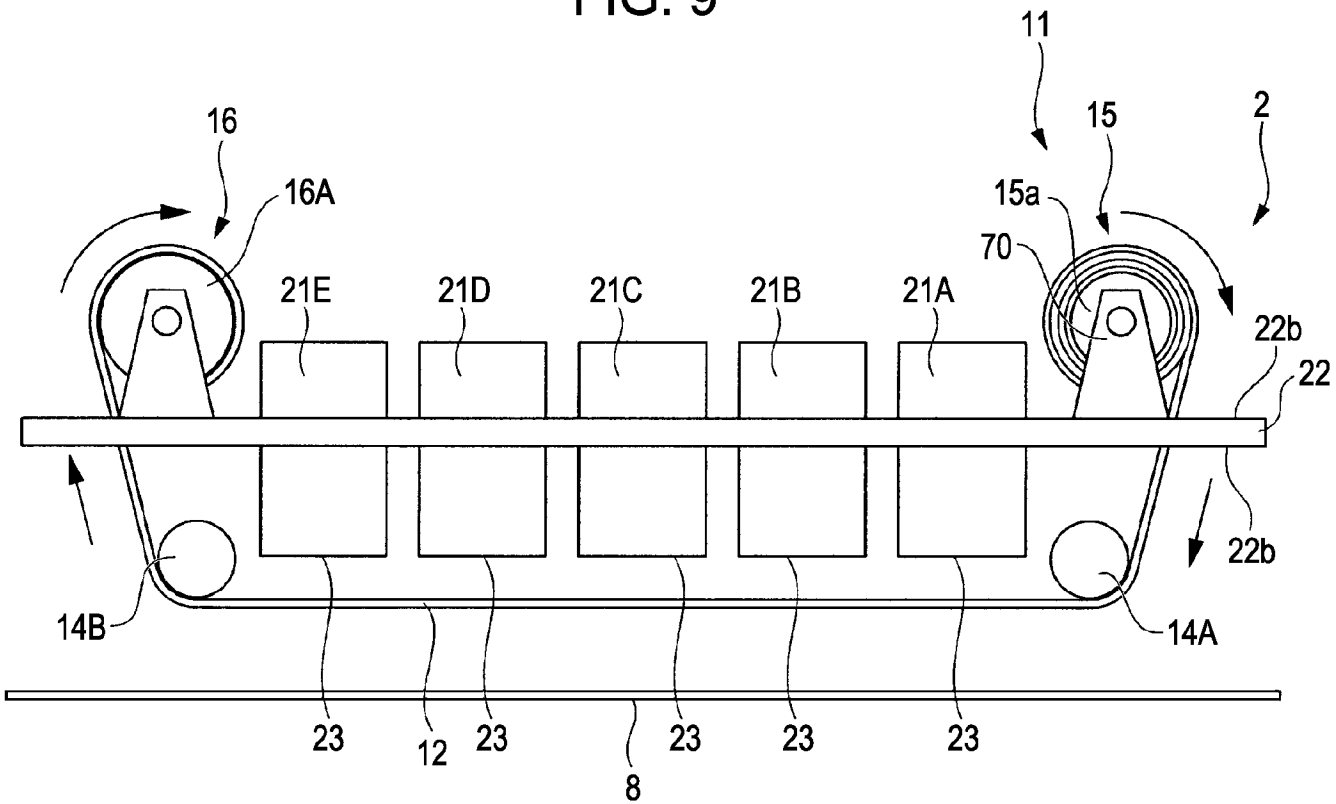
FIG. 9 is a sectional view of a main part illustrating the operation of the printer according to the first embodiment.
Figure 10A:
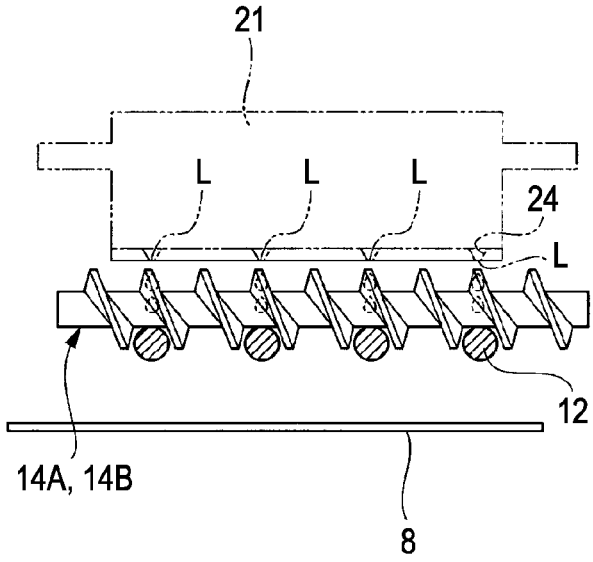
FIGS. 10A and 10B are diagrams respectively illustrating a flushing position of the absorbing member and a retraction position of the absorbing member.
Figure 10B:
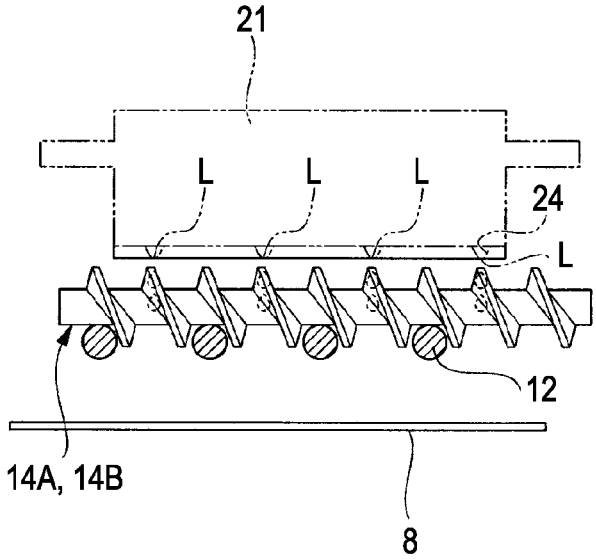

Next, the operation of the printer 1 according to this embodiment during the above-described flushing operation will be described with reference to the flowchart shown in FIG. 7. FIGS. 9, 10A, and 10B are sectional views of a main part illustrating the operation of the printer. In addition, the operation of the printer 1 according to this embodiment is generally controlled by a control device (not shown).

The printer 1 starts the flushing operation on the basis of a predetermined command.

First, the control device drives the moving mechanism 14 shown in FIG. 9 (S1 in FIG. 7) so as to move the plural supported absorbing members 12 to the flushing position shown in FIG. 10A. In detail, when the moving members 14A and 14B are rotated at a predetermined rpm (in this embodiment, one turn), the absorbing members 12 face the nozzle rows L of the printing heads 21A to 21E. At this time, as shown in FIG. 9, the absorbing members 12 face the nozzle rows L disposed in the arrangement direction of the printing heads 21A to 21E.

Likewise, four absorbing members 12 are disposed in the ink ejecting direction of the nozzle rows L.

Subsequently, the control device performs the flushing operation on the head unit 2 (S2 in FIG. 7) so as to eject ink droplets (for example, 10 droplets) from the nozzle rows L (the nozzles 24) of the printing heads 21A to 21E to the absorbing members 12. The ink droplets ejected from the nozzle rows L are absorbed by the absorbing members 12.

Figure 7:
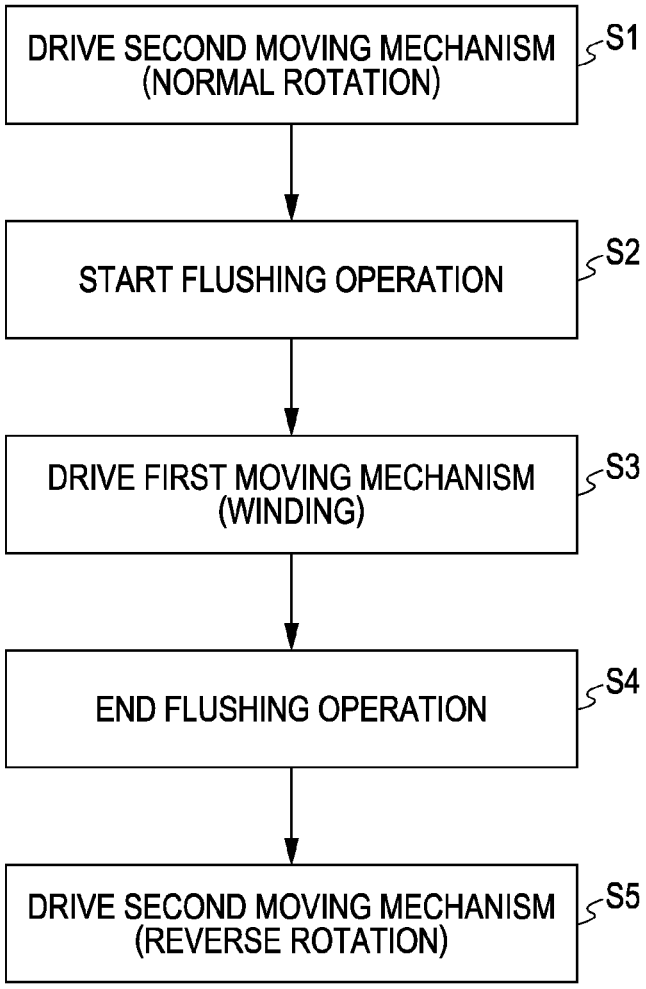
FIG. 7 is a flowchart illustrating an operation of the printer according to the first embodiment.

The control device drives the moving mechanism 13 and moves each of the absorbing members 12 in a direction depicted by the arrow in FIG. 9 during a time when the flushing operation is performed on the head unit 2 so as to perform an operation of winding the ink absorbing portion of the absorbing member 12 (S3 in FIG. 7). That is, in the printer 1 according to this embodiment, the moving mechanism 13 moves the absorbing member 12 in the extension direction during the flushing operation under the control of the control device. Accordingly, since the ink droplets ejected from the nozzle rows L are ejected onto a new portion not containing the ink of the absorbing member 12, the ink droplets are reliably and rapidly absorbed into the absorbing member 12.

In addition, in the case where the maximum dimension of the section of the absorbing member 12 is reliably 75 times larger than the diameter of the nozzle, the ink absorbing amount of the absorbing member 12 very increases. For this reason, it is not necessary to perform the operation of winding the absorbing member 12 while performing the flushing operation. For example, in the case where the ink is not dropped even when 100 droplets of ink are ejected onto the same position of the absorbing member 12, a new portion of the absorbing member 12 may be supplied after performing the flushing operation 10 times.

That is, in the printer 1 according to this embodiment, the moving mechanism 13 may move the absorbing member after performing the flushing operation plural times. Accordingly, the same region of the absorbing member 12 is used to receive the ink droplets plural times, and hence the absorbing member 12 is capable of absorbing a large amount of ink.

In this embodiment, the moving mechanism 13 controls the winding speed of the absorbing member 12 in accordance with the amount of ejected ink. When the amount of ejected ink is large, the winding speed increases so that the absorbing member 12 is not saturated, and the absorbing member 12 is wound at a high speed so as to prevent a case where the ink is not absorbed.

When the flushing operation ends (S4 in FIG. 7), the control device drives the moving mechanism 14 so as to move the plural absorbing members 12 to the retraction position as shown in FIG. 9B (S5 in FIG. 7). In detail, when the moving members 14A and 14B are reversely rotated at a predetermined rpm, the absorbing member 12 facing the nozzle row L is retracted from the position where the absorbing member 12 faces the nozzle row L. In addition, the above-described winding operation may be performed after the retraction operation.

Subsequently, the control device restarts the printing operation performed on the printing sheet.

Then, after performing the flushing operation plural times during the printing operation, when most of the absorbing member 12 wound around the rotation portion 15 of the moving mechanism 13 is wound around the rotation portion 16, and the absorbing member 12 cannot be supplied any more to the rotation portion 16, the absorbing member 12 is exchanged with new one. As shown in FIG. 9, since the moving mechanism 13 according to this embodiment is separably attached to the rear surface 22*b* of the attachment plate 22 through the attachment member 70, it is possible to easily exchange the absorbing member 12.

According to this embodiment, since the linear absorbing member 12 is disposed between the printing sheet 8 and the printing head 21, and the linear absorbing member 12 is moved so as to face the nozzle of the printing head 21 and to absorb ink during the flushing operation, it is possible to perform the flushing operation without moving the head unit 2. Since it is not necessary to move the head unit 2, it is possible to rapidly perform the flushing operation at the appropriate timing.

In addition, since the absorbing member 12 is formed as a thin linear shape member, the moving distance thereof is short, and the movement thereof is performed in a short time. For example, it is possible to dispose the absorbing member 12 between the corresponding position between the nozzle rows during the printing operation.

Further, since the linear member is used as the absorbing member 12, it is possible to prevent a rising air stream from being generated in the vicinity of the absorbing member 12 and to prevent the ink from being attached to the heads 21A to 21E when the ink is dropped onto the absorbing member 12. For this reason, it is possible to move the absorbing member 12 to be close to the heads 21A to 21E, and to suppress the occurrence of mist caused by the volatilization of ink and contaminating the heads 21A to 21E or the like.

Furthermore, since the ejection target is the linear absorbing member 12 during the flushing operation, the dot omission hardly occurs due to the influence of wind pressure generated upon ejecting ink to the absorbing member 12. In addition, since all the ink droplets ejected during the flushing operation are absorbed by the absorbing member 12 in the vicinity of the nozzle 24, it is possible to prevent the printing sheet or the transporting belt portion 33 from being contaminated.

Moreover, since the winding speed of the absorbing member 12 is changed in accordance with the amount of ejected ink, it is possible to perform the operation of winding the absorbing member 12 during a time when the absorbing member 12 is not saturated by the ink. Accordingly, it is possible to reliably absorb the ink into the absorbing member 12 without omitting the ink during the flushing operation.

As described above, in this embodiment, since it is possible to rapidly perform the flushing operation with a simple configuration, it is possible to improve the printing performance.

In addition, in the above-described embodiment, although the absorbing member 12 is adapted to be frequently wound during the flushing operation, when it is not necessary to wind the absorbing member 12 due to the small amount of ejected ink, the absorbing member 12 may be in a stop state.

Further, the moving mechanism 14 may include a position adjusting mechanism which adjusts a position of the absorbing member 12 in a direction perpendicular to the nozzle row L. Accordingly, it is possible to reliably move the absorbing member 12 to a position facing the nozzle row L, and to reliably retract the absorbing member 12 to a position not facing the nozzle row L.

Furthermore, during the printing operation, the plural absorbing members 12 may be largely retracted to a position not facing the nozzle surface 23 of the printing head 21. In addition, during the capping operation using the cap unit, when the absorbing member 12 is retracted in the same manner, it is possible to satisfactorily cap the nozzle surface 23 of the printing head 21 by using the cap portion 61.

Moreover, when a narrow tape-shaped member (cloth or the like) is used as the absorbing member, it is possible to satisfactorily seal the nozzle surface 23 even in the state where the absorbing member is interposed between the printing head 21 and the cap portion 61.

As described above, in the printer 1 according to this embodiment, in the state where the linear absorbing member 12 (the absorbing member formed by the linear member) faces the nozzle row (the state where the absorbing member 12 is disposed in the path in which the ink is ejected and flies from the nozzles 24), it is possible to allow the absorbing member 12 to absorb the ink ejected from the nozzles 24. In addition, since the absorbing member 12 is formed in a linear shape, it is possible to move the absorbing member 12 to the retraction position where the absorbing member 12 is retracted from the ink flying path. For this reason, in the printer 1 according to this embodiment, it is possible to perform the maintenance in a short time.

Further, in the printer 1 according to this embodiment, the absorbing member 12 is moved by the moving members 14A and 14B and the driving device 14C rotationally driving the moving members 14A and 14B. For this reason, it is possible to perform the flushing operation with a very simple configuration.

Furthermore, in the printer 1 according to this embodiment, the absorbing member 12 moves in the extension direction by rotationally driving the rotation portions 15 and 16. For this reason, it is possible to move the absorbing member 12 with a very simple configuration.

Second Embodiment

The basic configuration of the ink jet printer according to a second embodiment described below is substantially the same as that according to the first embodiment, but the configuration of the flushing unit is different. Accordingly, in the below description, the point different from the above-described embodiment will be described in detail, and the description for the common point will be omitted. In addition, in the respective drawings used for the description, the same reference numerals will be given to the same constituents as those in FIGS. 1 to 10.

Figure 11A:
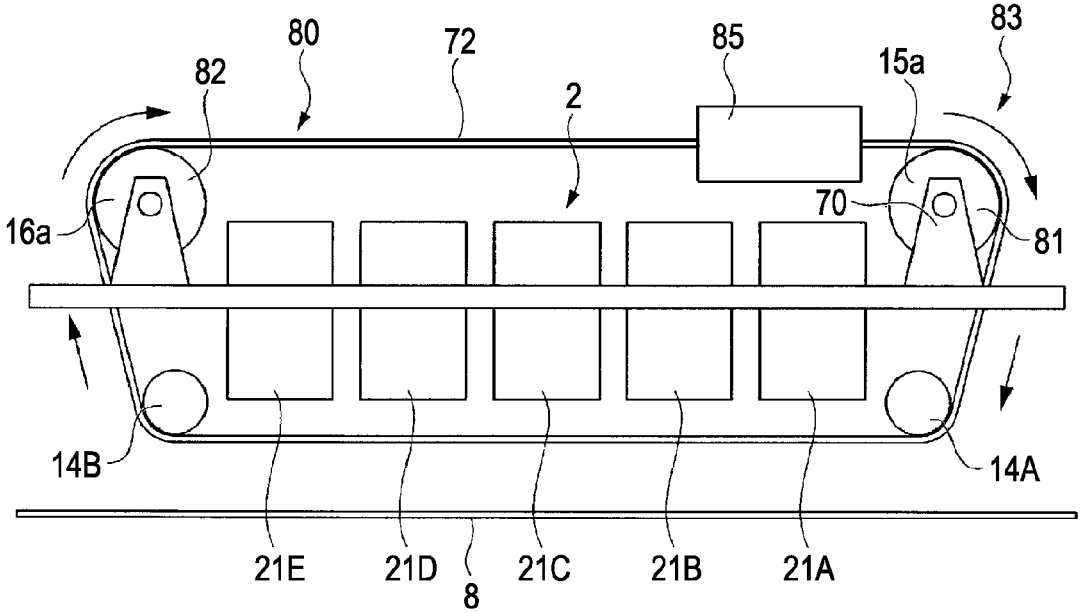
FIGS. 11A and 11B are views illustrating a configuration of a main part of the printer according to a second embodiment, where
Figure 11B:
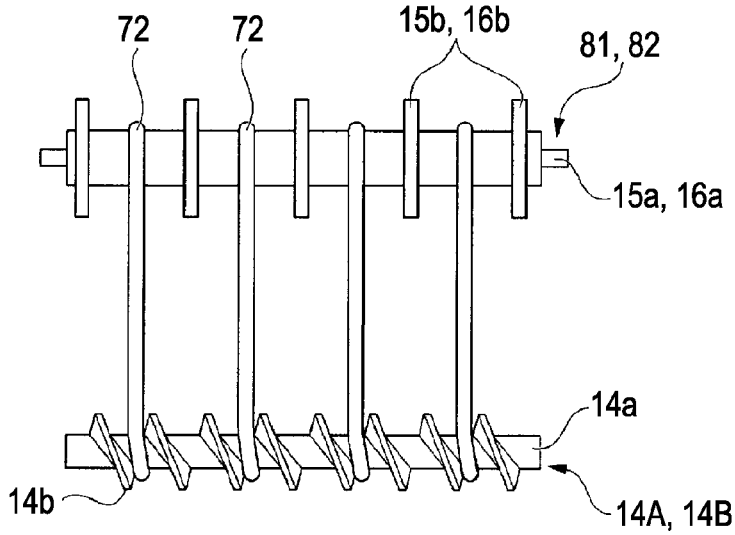

FIG. 11A is a sectional view illustrating a schematic configuration of the printer according to the second embodiment, and FIG. 11B is a side view illustrating the flushing unit.

A flushing unit 80 according to this embodiment includes the moving mechanism 14 which has the moving members 14A and 14B, a moving mechanism 83 which has a driving roller 81 and a driven roller 82, plural absorbing members 72 which are suspended on the moving members 14A and 14B, the driving roller 81, and the driven roller 82, and a cleaning mechanism 85.

The moving mechanism 83 includes the driving roller 81 and the driven roller 82, and constitutes a pulley mechanism together with the plural absorbing members 72 suspended therebetween. Each of the rollers 81 and 82 is fixed to the rear surface 22*b* of the attachment plate 22 through an attachment member 70. The configuration of the driving roller 81 and the driven roller 82 are the same as that of the above-described rotation portions 15 and 16. As shown in FIG. 11B, each of the annular absorbing members 72 is wound around the rotation shafts 15*a* and 16*a* between the partitioning plates 15*b* and 16*b*.

Since one end of the rotation shaft 15*a* is connected to a driving motor (not shown), the driving roller 81 is rotationally driven by the driving motor. In addition, the rotation force of the driving roller 81 is transmitted to the absorbing members 72 so that the absorbing members 72 are rotated. The driven roller 82 is a so-called free roller which supports the absorbing members 72 and is rotated in a following manner by the rotation driving operation of the driving roller 81.

The cleaning mechanism 85 is a cleaning mechanism which cleans the absorbing members 72 containing ink and is used to recycle the absorbing members 72 by recovering the ink absorbing ability. The cleaning mechanism 85 is disposed at a predetermined position in the moving path of the absorbing members 72 so that the plural absorbing members 72 pass through the inside of the cleaning mechanism 85.

In addition, since the cleaning mechanism 85 is used to recycle the absorbing members 72 by recovering the ink absorbing ability, for example, a felt member or the like may be used to suck the ink absorbed into the absorbing members 72.

According to this embodiment, since it is possible to recycle the absorbing members 72 by cleaning the absorbing members 72 absorbing the ink, it is possible to continuously use the absorbing members 72. Accordingly, it is not necessary to exchange the absorbing members 72. In addition, it is possible to reduce the effort involved in the exchange operation, and to decrease the cost for the absorbing members 72.

While the preferred embodiments of the invention are described as above with reference to the accompanying drawings, it is needlessly to say that the invention is not limited to the preferred embodiments, and the preferred embodiments may be combined with each other. It is apparent that various modifications and corrections can be made by the person skilled in the art within the scope of the technical spirit according to the claims, and it should be, of course, understood that the modifications and corrections are included in the technical scope of the invention.

For example, the printer 1 according to the first embodiment may be provided with a cleaning mechanism. In this case, when the cleaning mechanism is disposed on the downstream side (the downstream side of the moving member 14*b*) in the moving direction of the absorbing member 12, it is possible to perform a cleaning operation in which the absorbing member 12 absorbing the ink is cleaned. Since the absorbing member 12, which is cleaned so as to be reused, is wound around the rotation portion 16, it is possible to perform the flushing operation again, for example, by rotating the rotation portions 15 and 16 in the reverse direction.

Further, the number of the absorbing members may be appropriately set in accordance with the nozzle rows L of the printing head 21. In the above-described embodiments, one absorbing member is provided for each of the nozzles rows L, but one absorbing member may be provided for plural nozzle rows L. In this case, a configuration is adopted in which the width of the absorbing member is set to match with the corresponding plural nozzle rows L.

Furthermore, in the first embodiment, the plural absorbing members 12 are adapted to be simultaneously wound, but may be adapted to be separately wound.

In the above-described embodiments, the configuration is described in which the absorbing members 12 extend in parallel to the extension direction of the nozzle rows. However, the invention is not limited thereto, and the extension direction of the absorbing members 12 may not be perfectly parallel to the extension direction of the nozzle rows. That is, in the invention, the meaning that the absorbing members extend along the extension direction of the nozzle rows includes the case where the extension line extending in the extension direction of the nozzle rows intersects the extension line extending in the extension direction of the absorbing members in the front region as well as the case where the extension direction of the absorbing members is perfectly parallel to the extension direction of the nozzle rows.

In the above-described embodiments, a configuration is described in which the invention is applied to the line head type printer. However, the invention is not limited thereto, but may be applied to a serial type printer.

In the above-described embodiments, a configuration is described in which the absorbing members 12 always move right below the heads 21A to 21E. However, the invention is not limited thereto, but may adopt a configuration in which the absorbing members 12 move to a region (for example, a region on the side portions of the heads 21A to 21E) deviated from the positions right below the heads 21A to 21E upon retracting the absorbing members 12.

In the above-described embodiments, a configuration is adopted in which a positional relationship between the absorbing members 12 and the heads 21A to 21E is changed by moving the absorbing members 12. However, the invention is not limited thereto, but a configuration may be adopted in which a positional relationship between the absorbing members 12 and the heads 21A to 21E is changed by moving the heads 21A to 21E.

In the above-described embodiments, a configuration is described in which the absorbing members 12 and 72 are located at the sheet transporting region between the printing sheet and the heads 21A to 21E. However, the invention is not limited thereto, but a configuration may be adopted in which the absorbing members 12 and 72 are located at a position below the sheet transporting region during the maintenance operation.

In the above-described embodiments, a configuration is adopted in which the pair of moving members 14A and 14B (lead screws) each having the convex portion 14*b* helically wound around the shaft portion 14*a* is used as a part of the first moving mechanism according to the invention. In addition, a configuration is described in which the arrangement pitch P1 of the convex portion 14*b* is ½ of the arrangement pitch P2 of the nozzle rows. However, the invention is not limited thereto, but a configuration may be adopted in which the arrangement pitch P1 of the convex portion 14*b* is set to 1/n (n is an integer equal to or more than 3) of the arrangement pitch P2 of the nozzle rows. Likewise, since the arrangement pitch P1 of the convex portion 14*b* is set to 1/n (n is an integer excluding 1) of the arrangement pitch P2 of the nozzle rows, it is possible to easily calculate the movement amount of the absorbing member 12 per each rotation of the moving members 14A and 14B, and to easily control the driving device 14C.

Figure 12:
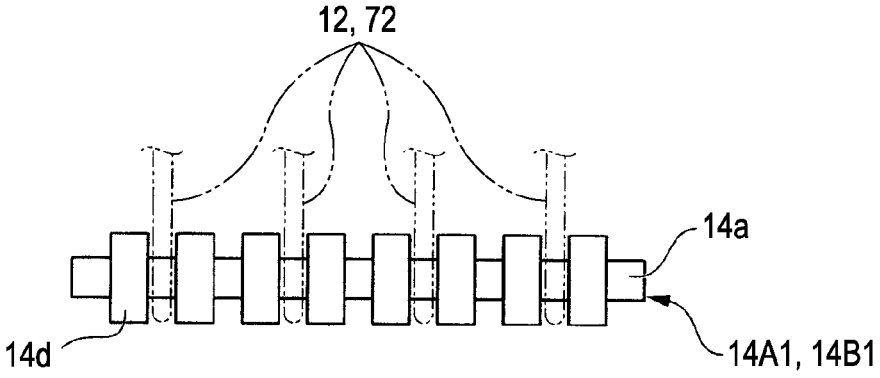
FIG. 12 is a plan view illustrating a modified example of a moving member used as a part of a first moving mechanism.

For example, as shown in FIG. 12, a configuration may be adopted which uses moving members 14A1 and 14B1 each having flange-shaped portions 14*c* arranged in the axial direction of the shaft portion 14*a* so as to have the same interval therebetween.

In addition, in the case where the moving members 14A1 and 14B1 are used, the absorbing member 12 is wound between the flange-shaped portion 14*c* and the flange-shaped portion 14*c*, and the moving members 14A1 and 14B1 are moved in the axial direction, thereby moving the absorbing members 12 and 72 in the sheet transporting direction.

In the above-described embodiments, the ink jet printer is adopted, but a fluid ejecting apparatus for ejecting a fluid other than ink or a fluid container for storing the fluid may be adopted. Various fluid ejecting apparatuses including a fluid ejecting head for ejecting a minute amount of liquid droplet may be adopted. In addition, the liquid droplet indicates the fluid ejected from the fluid ejecting apparatus, and includes a liquid having a particle shape, a tear shape, or a linear shape. Further, here, the fluid may be a material which can be ejected from the liquid ejecting apparatus.

For example, a liquid-state material may be used, and includes a liquid-state material such as sol or gel water having a high or low viscosity, a fluid-state material such as an inorganic solvent, an organic solvent, a liquid, a liquid-state resin, or liquid-state metal (metallic melt), and a material in which a functional material having a solid material such as pigment or metal particle is dissolved, dispersed, or mixed with a solvent in addition to a fluid. In addition, ink or liquid crystal described in the embodiments may be exemplified as a typical example of the fluid. Here, the ink indicates general water-based ink, oil-based ink, gel ink, or hot-melt ink which contains various fluid compositions.

As a detailed example of the fluid ejecting apparatus, for example, a liquid crystal display, an EL (electro-luminance) display, a plane-emission display, a fluid ejecting apparatus for ejecting a fluid containing dispersed or melted materials such as an electrode material or a color material used to manufacture a color filter, a fluid ejecting apparatus for ejecting a biological organic material used to manufacture a biochip, a fluid ejecting apparatus for ejecting a fluid as a sample used as a precise pipette, a silkscreen printing apparatus, or a micro dispenser may be used.

In addition, a fluid ejecting apparatus for ejecting lubricant from a pinpoint to a precise machine such as a watch or a camera, a fluid ejecting apparatus for ejecting a transparent resin liquid such as a UV-curing resin onto a substrate in order to form a minute hemispherical lens (optical lens) used for an optical transmission element or the like, or a fluid ejecting apparatus for ejecting an etching liquid such as an acid liquid or an alkali liquid in order to perform etching on a substrate or the like may be adopted. Further, the invention may be applied to any one of the fluid ejecting apparatuses and a fluid container thereof.

What is claimed is:

1. A fluid ejecting apparatus comprising:

an absorbing member;

a fluid ejecting head which includes nozzle rows each having a plurality of nozzles and ejects a fluid onto a medium, the fluid ejecting apparatus being capable of performing a flushing operation in which the fluid is ejected to the absorbing member used to absorb the fluid ejected from the nozzles, wherein the absorbing member extends along the nozzle row in an extension direction and is capable of relatively moving between a first position where the absorbing member faces the plurality of nozzles to absorb liquid ejected from the plurality of nozzles and a second position retracted from a flying path of the fluid ejected from the nozzles, wherein the absorbing member moves from the first position to the second position in a direction intersecting the extension direction, wherein the absorbing member is capable of moving in the extension direction and in the direction intersecting the extension direction.

2. The fluid ejecting apparatus according to claim 1, wherein the absorbing member is provided between the fluid ejecting head and the medium.

3. The fluid ejecting apparatus according to claim 1, wherein a sectional dimension of the absorbing member is equal to or more than 5 times and equal to or less than 75 times a diameter of each of the nozzles.

4. The fluid ejecting apparatus according to claim 1, wherein a sectional dimension of the absorbing member is equal to or more than 10 times and equal to or less than 50 times a diameter of each of the nozzles.

5. The fluid ejecting apparatus according to claim 1, further comprising:

a first moving mechanism which moves the absorbing member in a direction intersecting the extension direction of the nozzle row.

6. The fluid ejecting apparatus according to claim 5, further comprising:

a second moving mechanism which moves the absorbing member in the extension direction by a rotation driving operation of a rotation body.

7. The fluid ejecting apparatus according to claim 6, wherein the second moving mechanism is moved by winding the absorbing member.

8. The fluid ejecting apparatus according to claim 6, wherein the second moving mechanism moves the absorbing member after the flushing operation is performed plural times.

9. The fluid ejecting apparatus according to claim 6, wherein the second moving mechanism moves the absorbing member during the flushing operation.

10. The fluid ejecting apparatus according to claim 5, wherein the first moving mechanism includes a lead screw around which the absorbing member is wound and a driving device which rotationally drives the lead screw.

11. The fluid ejecting apparatus according to claim 10, wherein the lead screw includes a shaft portion and a convex portion which is helically wound around the shaft portion, and wherein an arrangement pitch of the convex portion in the axial direction of the lead screw is set to 1/n (n is an integer excluding 1) of an arrangement pitch of the nozzle rows.

12. The fluid ejecting apparatus according to claim 11, wherein the arrangement pitch of the convex portion in the axial direction of the lead screw is set to ½ of the arrangement pitch of the nozzle rows, and wherein the absorbing member is moved when the lead screw is rotated one turn by the driving device.

13. The fluid ejecting apparatus according to claim 10, wherein a plurality of the absorbing members is provided, and the absorbing members are wound around the lead screw at an arrangement pitch of the nozzle rows.

14. The fluid ejecting apparatus according to claim 1, wherein the absorbing member has a circular sectional shape.

15. The fluid ejecting apparatus according to claim 1, wherein the absorbing member is formed by twisting a plurality of strings.

16. The fluid ejecting apparatus according to claim 1, wherein a plurality of the nozzle rows is provided, and the absorbing member is provided for each of the nozzle rows.

17. A fluid ejecting apparatus comprising:

an absorbing member;

a fluid ejecting head which includes nozzle rows each having a plurality of nozzles and ejects a fluid onto a medium, the fluid ejecting apparatus being capable of performing a flushing operation in which the fluid is ejected to the absorbing member used to absorb the fluid ejected from the nozzles, wherein the absorbing member extends along the nozzle row in an extension direction and is capable of relatively moving between a first position where the absorbing member faces the plurality of nozzles to absorb liquid ejected from the plurality of nozzles and a second position retracted from a flying path of the fluid ejected from the nozzles, wherein the fluid ejecting head is capable of ejecting the fluid to a medium transported in a direction that intersects the extension direction, wherein the absorbing member moves from the first position to the second position in a direction intersecting the extension direction, wherein the absorbing member is supported at sides of the fluid ejecting head in the extension direction.

18. A fluid ejecting apparatus comprising:

an absorbing member;

a cleaning mechanism which cleans the absorbing member; and a fluid ejecting head which includes nozzle rows each having a plurality of nozzles and ejects a fluid onto a medium, the fluid ejecting apparatus being capable of performing a flushing operation in which the fluid is ejected to the absorbing member used to absorb the fluid ejected from the nozzles, wherein the absorbing member extends along the nozzle row in an extension direction and is capable of relatively moving between a first position where the absorbing member faces the plurality of nozzles to absorb liquid ejected from the plurality of nozzles and a second position retracted from a flying path of the fluid ejected from the nozzles, and wherein the absorbing member moves from the first position to the second position in a direction intersecting the extension direction.

* * * * *